US010640994B2

(12) United States Patent
Schneider

(10) Patent No.: US 10,640,994 B2
(45) Date of Patent: May 5, 2020

(54) CEILING FORMWORK COMPRISING A FORMWORK PART HAVING A COMPENSATION ELEMENT

(71) Applicant: PERI GMBH, Weissenhorn (DE)

(72) Inventor: Werner Schneider, Erbach (DE)

(73) Assignee: PERI GMBH, Weissenhorn (DE)

( * ) Notice: Subject to any disclaimer, the term of this patent is extended or adjusted under 35 U.S.C. 154(b) by 77 days.

(21) Appl. No.: 15/777,277

(22) PCT Filed: Nov. 29, 2016

(86) PCT No.: PCT/EP2016/079085
§ 371 (c)(1),
(2) Date: May 18, 2018

(87) PCT Pub. No.: WO2017/093225
PCT Pub. Date: Jun. 8, 2017

(65) Prior Publication Data

US 2018/0334816 A1 Nov. 22, 2018

(30) Foreign Application Priority Data

Nov. 30, 2015 (DE) ..... 10 2015 223 762

(51) Int. Cl.
*E04G 11/50* (2006.01)
*E04G 11/48* (2006.01)
*E04G 11/54* (2006.01)

(52) U.S. Cl.
CPC ..... *E04G 11/48* (2013.01); *E04G 11/50* (2013.01); *E04G 11/54* (2013.01)

(58) Field of Classification Search
CPC ..... E04G 11/36; E04G 11/38; E04G 11/48; E04G 11/483; E04G 11/486; E04G 11/50; E04G 2011/505
(Continued)

(56) References Cited

U.S. PATENT DOCUMENTS 622,666 A 4/1899 Burwell
2010/0025563 A1* 2/2010 Seng ..... E04G 11/02 249/24

FOREIGN PATENT DOCUMENTS

CA 2085536 A 6/1994
DE 20318912 U1 3/2004
(Continued)

*Primary Examiner* — Michael Safavi
(74) *Attorney, Agent, or Firm* — Lucas & Mercanti, LLP; Klaus P. Stoffel

(57) ABSTRACT

A formwork part having a compensation element with two transverse supports connected to a longitudinal support. An outer support is movably situated on the transverse supports. A center support may be detachably fastened to the transverse supports. The longitudinal support, the outer support, and/or the center support have/has, preferably at both ends, at least one support head receptacle, in particular formed as a connecting protrusion, in particular at least two support head receptacles, preferably formed as connecting protrusions. The connecting protrusions may be hooked into ceiling supports of the ceiling formwork. The ceiling formwork includes such a formwork part and a formwork element. The formwork element has at least one support head receptacle, in particular formed as a connecting protrusion, which may be hooked into the ceiling support of the ceiling formwork. The ceiling formwork may include the ceiling support, and the ceiling formwork may have a dual support.

15 Claims, 5 Drawing Sheets

(58) Field of Classification Search
USPC ..... 249/18, 26, 28
See application file for complete search history.

(56) References Cited

FOREIGN PATENT DOCUMENTS

| | | | |
|---|---|---|---|
| DE | 102005031151 | A1 | 1/2007 |
| DE | 102007021159 | A1 | 11/2008 |
| DE | 202013104108 | U1 | 9/2013 |
| EP | 2754778 | A1 | 7/2014 |
| FR | 2955877 | A1 | 8/2011 |
| GB | 2000542 | A | 1/1979 |
| WO | 2015042625 | A1 | 4/2015 |

* cited by examiner

CEILING FORMWORK COMPRISING A FORMWORK PART HAVING A COMPENSATION ELEMENT

CROSS-REFERENCE TO RELATED APPLICATIONS

The present application is a 371 of International application PCT/EP2016/079085, filed Nov. 29, 2016, which claims priority of DE 10 2015 223 762.1, filed Nov. 30, 2015, the priority of these applications is hereby claimed and these applications are incorporated herein by reference.

BACKGROUND OF THE INVENTION

The invention relates to a formwork part for a ceiling formwork, the formwork part having a compensation element. The invention further relates to a ceiling formwork comprising such a formwork part.

It is known to use formwork elements for producing concrete ceilings. In particular frame panel formwork elements, which at least partially form a mold for filling liquid concrete, are used. The formwork elements are removed after the concrete has hardened.

Formwork elements cannot be adapted to any given surfaces. To allow gaps between the formwork elements and a wall to be closed, temporary structures are known which bear a support structure having a formwork shell that is individually customized to the gap.

SUMMARY OF THE INVENTION

Accordingly, an object of the present invention is to provide a formwork part which has a compensation element, and which is flexibly adaptable for closing a gap between a formwork element and a wall and is reusable. A further object of the invention is to provide a ceiling formwork comprising such a formwork part.

This object is achieved according to the invention by a formwork part having the features of Patent Claim 1, and by a ceiling formwork having the features of Patent Claims 14 and 15. The subclaims set forth advantageous refinements.

The object according to the invention is thus achieved by a formwork part for a ceiling formwork. The formwork part has a compensation element. The compensation element has a base frame. The base frame has a longitudinal support with a nail strip, to which a compensation element formwork shell of the ceiling formwork is fastenable. The longitudinal support is fixedly connected to a first transverse support and to a second transverse support of the base frame. Within the meaning of the present invention, "fixedly connected" means that detachment of the longitudinal support from the transverse supports is not possible without a tool. The connection may be established by welding, screwing, riveting, or gluing, for example. The compensation element also has an outer support which, in particular in parallel alignment with the longitudinal support, is displaceably guided on the two transverse supports. The outer support has a nail strip for fastening a compensation element formwork shell.

The formwork part according to the invention thus has two nail strips, which are adjustable relative to one another, for accommodating a compensation element formwork shell. The formwork part may thus be adapted to individual existing gaps in a ceiling formwork and reused.

The outer support is preferably displaceably situated on the transverse supports so as to be detachably removable, but not in a reversible manner, from the transverse supports. The outer support which is captively secured to the transverse supports allows compact handling of the formwork part.

The transverse support may be designed for engaging beneath an adjacent formwork element.

The outer support is preferably lockable in various positions relative to the transverse supports.

In another preferred embodiment of the invention, the formwork part has a first center support. The center support may be situated in parallel to the longitudinal support. In particular, the first center support is reversibly detachably connected to the transverse supports. The first center support may have a nail strip for fastening the compensation element formwork shell. The first center support provides an additional support for the compensation element formwork shell when the latter must be installed over a large surface area. In addition, it is possible to remove the first center support, and use it alone as a support for narrow gaps to be closed. That is, the center support is designed in such a way that it is connectable to a support head, even without a base frame.

A first transverse support may have a first transverse support guide strip. The first transverse support guide strip may be used to fasten the first center support and/or the outer support. The first center support and/or the outer support may have a first center support guide strip or a first outer support guide strip, respectively, that engages behind the first transverse support guide strip. The first center support or the outer support may thus be guided on the first transverse support in a structurally simple manner.

In addition, a second transverse support may have a second transverse support guide strip. The second transverse support guide strip may be used to fasten the first center support and/or the outer support. The first center support and/or the outer support may have a second center support guide strip or a second outer support guide strip that engages behind the second transverse support guide strip. The first center support or the outer support may thus be guided on the two transverse supports in a particularly precise manner.

A locking device may be provided on at least one transverse support in order to fix the position of the first center support. The locking device may allow continuous adjustability of the first center support relative to a transverse support. For example, the locking device may be designed in the form of a wedge fastener. The locking device may allow discrete adjustability of the first center support relative to a transverse support. For example, the first transverse support may have multiple first pegging openings into which a first pin, movably situated on the first center support, is insertable, so that the position of the first center support is lockable on the first transverse support.

Furthermore, the second transverse support may have multiple second pegging openings into which a second pin, movably situated on the first center support, is insertable, so that the position of the first center support is also adjustable on the second transverse support, and thus, on the base frame in a particularly precise manner.

The first center support may have support head receptacles to allow the first center support to be fixed to a support head. The support head receptacles may be designed in the form of connecting protrusions which may partially engage behind the support heads. The connecting protrusions are preferably situated or provided on the ends of the first center support, viewed in the direction of the longitudinal axis of the first center support.

The connecting protrusions are preferably provided on sheet metal strips that are situated, in particular welded, in the area of the ends of the first center support, viewed in the direction of the longitudinal axis of the first center support.

The longitudinal support may have support head receptacles. The longitudinal support particularly preferably has connecting protrusions that are able to partially engage behind the support heads. The connecting protrusions are preferably situated or provided on the ends of the longitudinal support, viewed in the direction of the longitudinal axis of the longitudinal support.

The connecting protrusions are preferably provided on sheet metal strips that are situated, in particular welded, in the area of the ends of the longitudinal support, viewed in the direction of the longitudinal axis of the longitudinal support.

The outer support may have support head receptacles. More preferably, the outer support head has support head receptacles in the form of connecting protrusions that are able to partially engage behind the support heads. The connecting protrusions are preferably situated or provided on the ends of the outer support, viewed in the direction of the longitudinal axis of the outer support.

The connecting protrusions are preferably provided on sheet metal strips that are situated, in particular welded, in the area of the ends of the outer support, viewed in the direction of the longitudinal axis of the outer support.

To allow large gaps in the formwork shell to be closed by a compensation element formwork shell, the compensation element may have at least one further center support, which in particular is identical to the first center support. The further center support is preferably reversibly detachably situatable on the transverse supports and/or lockable with displaceability relative to the transverse supports.

The stability of the base frame may be significantly increased when the base frame has a longitudinal connector that connects the transverse supports. The longitudinal connector is preferably oriented in parallel to the longitudinal support.

The formwork part may have a support head. In this case, the compensation element, the first center support, and/or a dual support (see below) are/is connected to the support head. The support head may be partially engaged from behind by a connecting protrusion.

The compensation element formwork shell may be an integral part of the compensation element.

The object according to the invention is further achieved by a ceiling formwork comprising a formwork part and a formwork element described above.

The ceiling formwork may have a dual support, the dual support having support head receptacles on its lengthwise ends. The support head receptacles are preferably designed in the form of connecting protrusions, which in particular are welded on. The dual support has at least one nail strip, in particular two nail strips.

The minimum width adjustability of the compensation element preferably corresponds to the width of the formwork element. The width adjustability of the compensation element is understood to mean the maximum width that is spanned or spannable by the compensation element formwork shell, minus the minimum width of the compensation element that is spanned or spannable by the compensation element formwork shell. For a rectangular formwork element, the width of the formwork element is understood to mean the shorter side of the formwork element in the plane of the formwork shell.

Further features and advantages of the invention result from the following description of several exemplary embodiments of the invention, from the patent claims, and from the figures of the drawing, which show particulars essential to the invention.

The features shown in the drawing are illustrated in such a way that the special characteristics according to the invention may be made clearly apparent. The various features may be implemented in variants of the invention, either singly, or collectively in arbitrary combinations.

DETAILED DESCRIPTION OF THE INVENTION

Figure 1:
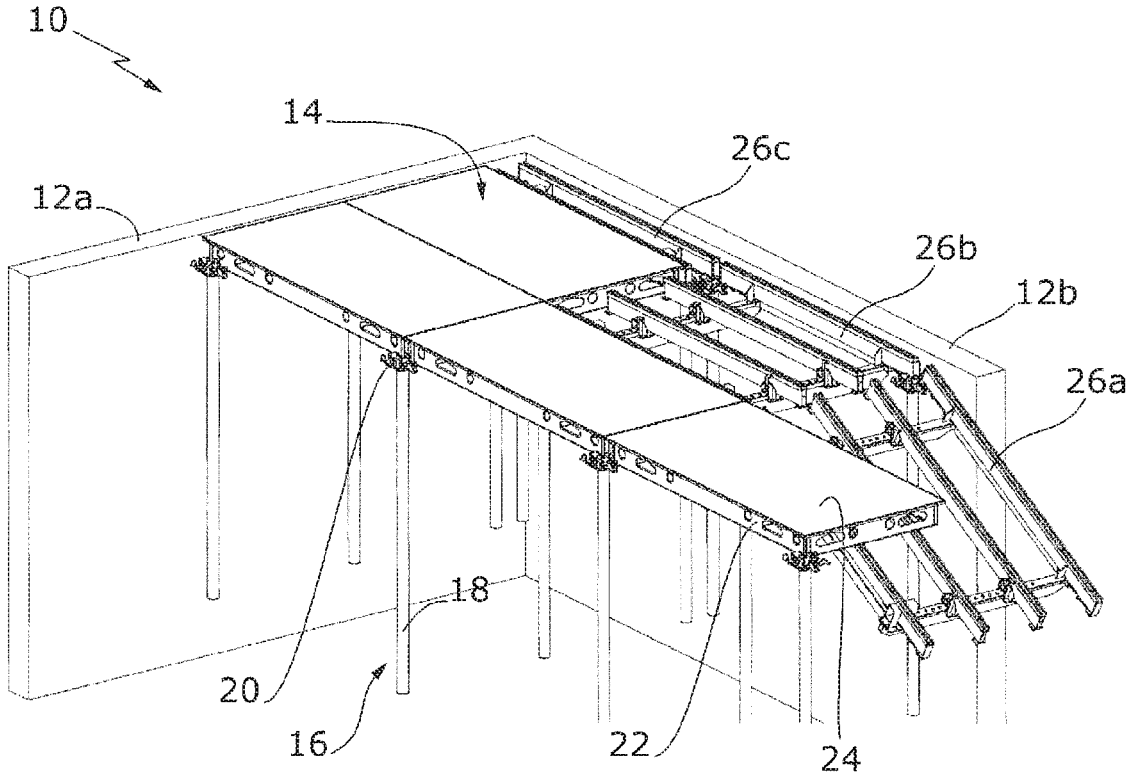
FIG. 1 shows a perspective view of a ceiling formwork with multiple formwork elements that are supported on ceiling supports, and with three formwork parts.

FIG. 1 shows a ceiling formwork 10. The ceiling formwork 10 is used to produce a concrete ceiling, which is supported on the walls 12*a*, 12*b*. The ceiling formwork 10 has multiple formwork elements, of which only one formwork element 14 is provided with a reference numeral for reasons of clarity. The formwork elements 14 are supported on ceiling supports, of which only one ceiling support 16 is likewise provided with a reference numeral in FIG. 1 for reasons of clarity. The ceiling support 16 has a formwork support 18 and a support head 20 situated thereon. The formwork elements 14 have a frame 22 with a formwork shell 24 situated thereon. The formwork elements 14 have a rectangular design, so that ceilings having arbitrary shapes are producible without using solely the formwork elements 14 illustrated in FIG. 1.

The ceiling formwork 10 therefore has formwork parts 26*a-c*. The formwork parts 26*a-c*, the same as the formwork elements 14, are supported by ceiling supports 16. In addition, the formwork parts 26*a-c*, the same as the formwork elements 14, are suspendable at one end in at least one support head 20, and may then be swiveled up from below. This is apparent in FIG. 1 with reference to the formwork part 26*a*. After the swiveling up, the formwork parts 26*a-c* may be supported on the swiveled-up end by at least one further ceiling support 16.

Figure 2:
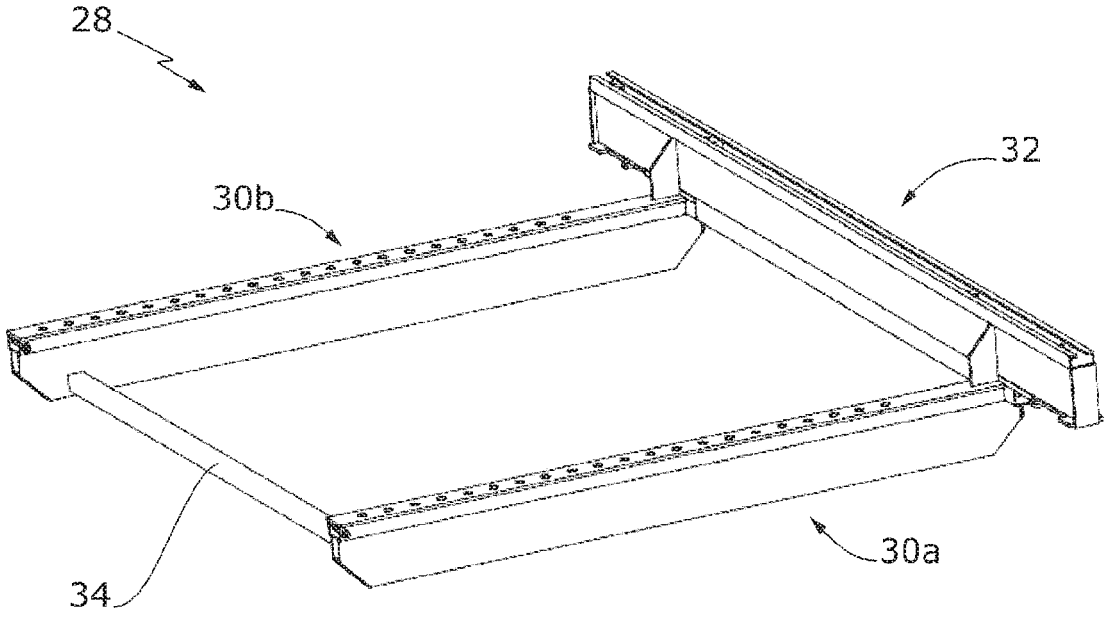
FIG. 2 shows a perspective view of a base frame of a formwork part.

FIG. 2 shows a base frame 28 of a formwork part 26*a-c* (see FIG. 1). The base frame 28 has a first transverse support 30*a*, a second transverse support 30*b*, and a longitudinal support 32. The longitudinal support 32 connects the transverse supports 30*a*, 30*b*. The connection of the transverse supports 30*a*, 30*b* is strengthened by a longitudinal connector 34. The longitudinal connector 34 is fixedly connected to the transverse supports 30*a*, 30*b*, opposite from the longitudinal support 32.

Figure 3:
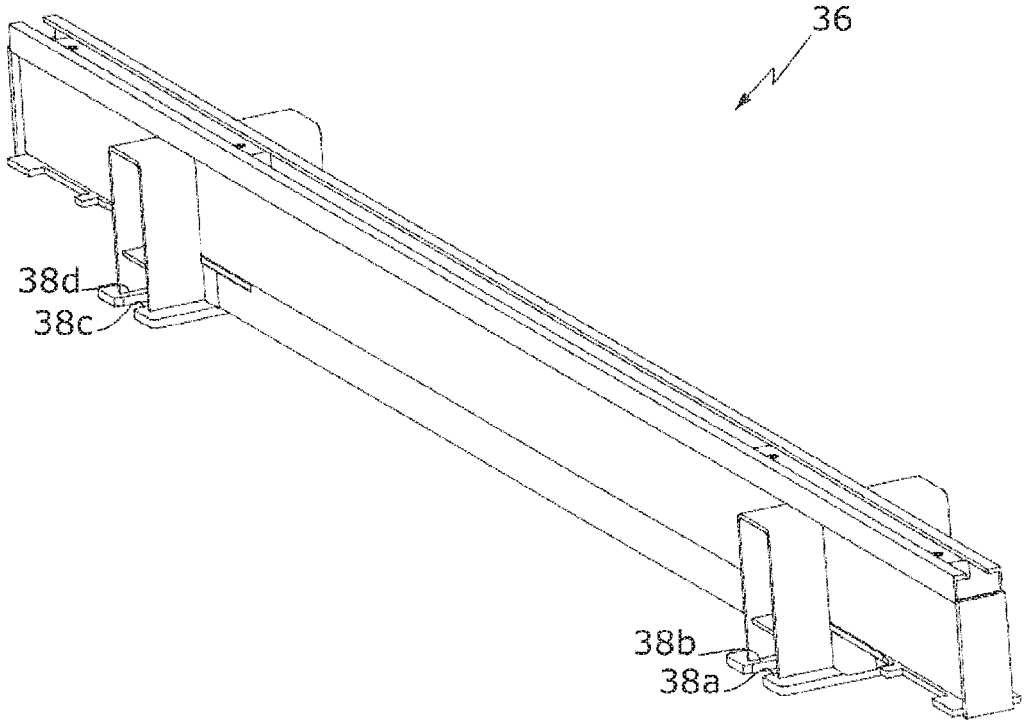
FIG. 3 shows a perspective view of an outer support.

FIG. 3 shows an outer support 36. The outer support 36 has outer support guide strips 38*a-d*.

Figure 4:
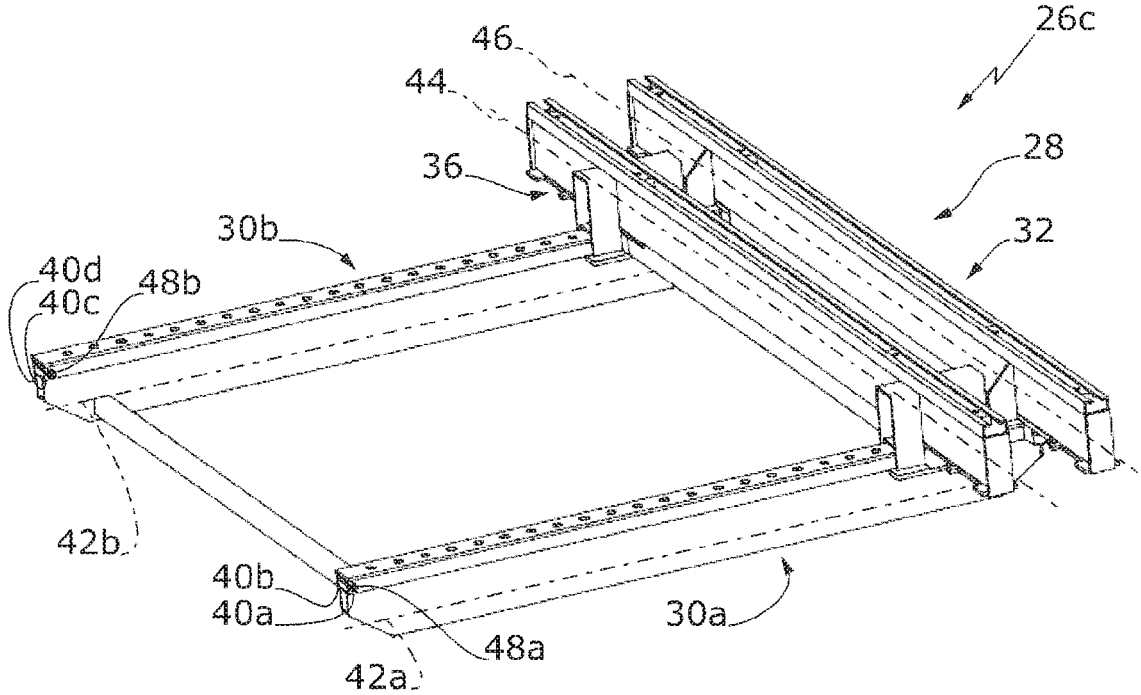
FIG. 4 shows a perspective view of the base frame from FIG. 2 together with the outer support according to FIG. 3.

FIG. 4 shows the formwork part 26*c* according to FIG. 1. The outer support 36 (see FIG. 3) is situated on the base frame 28 (see FIG. 2). The outer support 36 with its outer support guide strips 38*a-d* (see FIG. 3) engages behind transverse support guide strips 40*a-d*. In the present exemplary embodiment, the outer support 36 is displaceably guided in the direction of the longitudinal axes 42*a*, 42*b*. In the present case, the outer support 36 is also displaceable in parallel alignment with the longitudinal support 32. In other words, the longitudinal axis 44 of the outer support 36 extends in parallel to the longitudinal axis 46 of the longitudinal support 32. At least one stop 48*a*, 48*b* prevents the outer support 36 from slipping out and falling off the transverse supports 30*a*, 30*b*. Each transverse support 30*a*, 30*b* preferably has at least one stop 48*a*, 48*b*.

Figure 5:
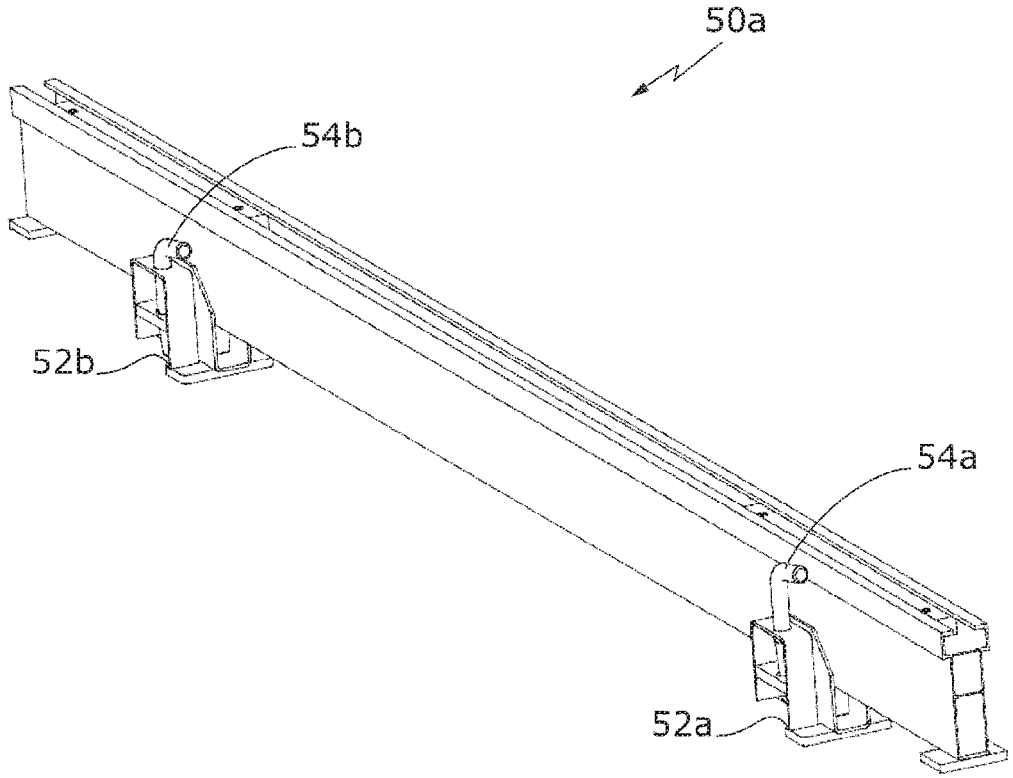
FIG. 5 shows a perspective view of a center support.

FIG. 5 shows a center support 50*a*. The center support 50*a* is preferably virtually identical to the outer support 36 (see FIG. 3). However, the center support 50*a* has only two center support guide strips 52*a*, 52*b*. In addition, the center support 50*a* has movably guided pins 54*a*, 54*b*.

Figure 6:
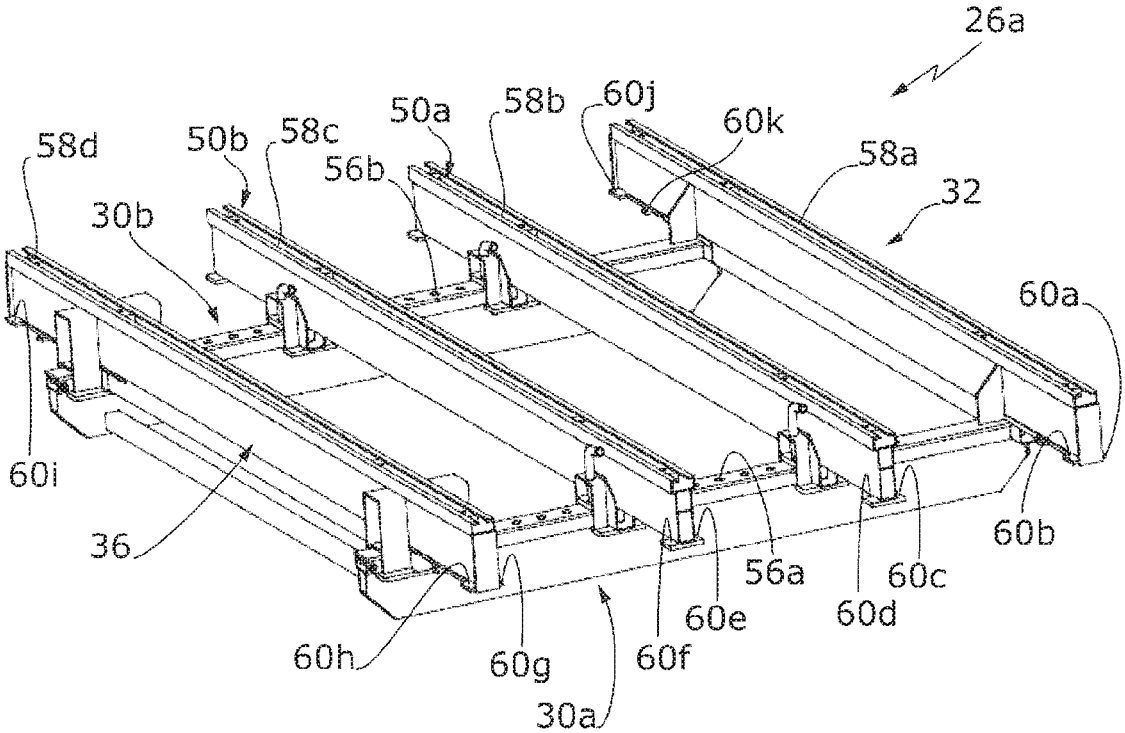
FIG. 6 shows a perspective view of a formwork part from FIG. 1.

FIG. 6 shows the formwork part 26*a* (see also FIG. 1). It is apparent from FIG. 6 that the transverse supports 30*a*, 30*b* of the formwork part 26*a* have pegging openings into which the pins 54*a*, 54*b* (see FIG. 5) are partially insertable. Only two pegging openings 56*a*, 56*b* are provided with a reference numeral in FIG. 6 for reasons of clarity. When the center support guide strips 52*a*, 52*b* (see FIG. 5) engage behind the transverse support guide strips 40*a*, 40*c* (see FIG. 4) and the pins 54*a*, 54*b* (see FIG. 5) are partially inserted into the pegging openings 56*a*, 56*b*, the center supports 50*a*, 50*b* are fixedly connected to the transverse supports 30*a*, 30*b*. In contrast, by loosening the pins 54*a*, 54*b* (see FIG. 5), the center supports 50*a*, 50*b* may be either moved in parallel in the direction of the longitudinal axes 42*a*, 42*b*, or removed from the transverse supports 30*a*, 30*b* without removing the longitudinal support 32 and/or the outer support 36 from the transverse supports 30*a*, 30*b*.

It is apparent from FIG. 6 that the longitudinal support 32, the center supports 50*a*, 50*b*, and the outer support 36 have a nail strip 58*a-d*, respectively. The nail strips 58*a-d* are preferably made of plastic or wood. They are used to fasten a customized-to-fit compensation element formwork shell (not shown).

The longitudinal support 32, the center supports 50*a*, 50*b*, and the outer support 36 at their respective lengthwise ends have support head receptacles in the form of connecting protrusions 60*a-k*, of which only some are provided with a reference numeral in FIG. 6 for reasons of clarity. The connecting protrusions 60*a-k* are preferably provided on sheet metal strips. The connecting protrusions 60*a-k* are designed to partially engage behind support heads 20 (see FIG. 1).

Figure 7:
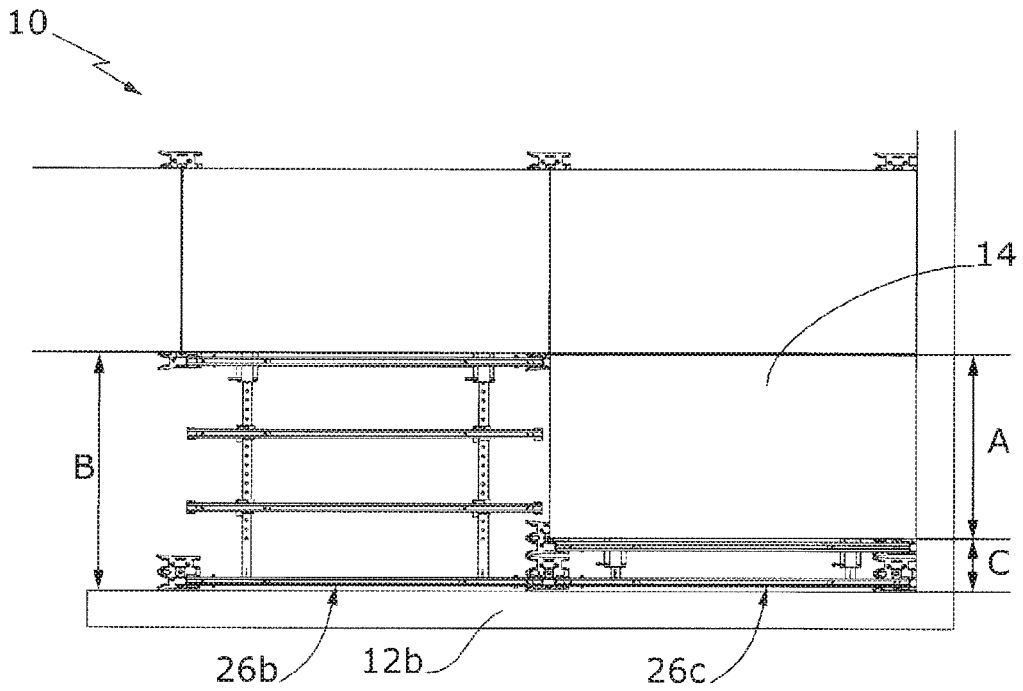
FIG. 7 shows a top view of a further ceiling formwork.

FIG. 7 shows a ceiling formwork 10 together with the formwork element 14 and the formwork parts 26*b*, 26*c*. The formwork element 14 has a width A perpendicular to its longitudinal axis and parallel to its formwork shell 24 (see FIG. 1). The formwork part 26*b* has a width B perpendicular to its longitudinal axis and parallel to a plane in which the transverse supports 30*a*, 30*b* extend (see FIG. 6), corresponding to the maximum span width of the formwork part 26*b*. The formwork part 26*c* has a width C perpendicular to its longitudinal axis and parallel to a plane in which the transverse supports 30*a*, 30*b* extend (see FIG. 6), corresponding to the minimum span width of the formwork part 26*c*. The width A corresponds, at most, to the difference between the widths B and C. Any given distances between the formwork element 14 and the wall 12*b* are achievable: If the distance of the formwork element 14 from the wall 12*b* exceeds the maximum span width of the formwork part 26*c*, a further formwork element 14 may be inserted. On the other hand, if the distance of the formwork element 14 from the wall 12*b* is less than the minimum span width of the formwork part 26*c*, the formwork element 14 may be removed, and, in its place, a formwork part 26*c* may be inserted which has a span width greater than the width A of the formwork element and less than the maximum span width B of the formwork part 26*c*. The transverse supports 30*a*, 30*b* of the formwork part 26*c* may partially engage beneath the formwork element 14.

Figure 8:
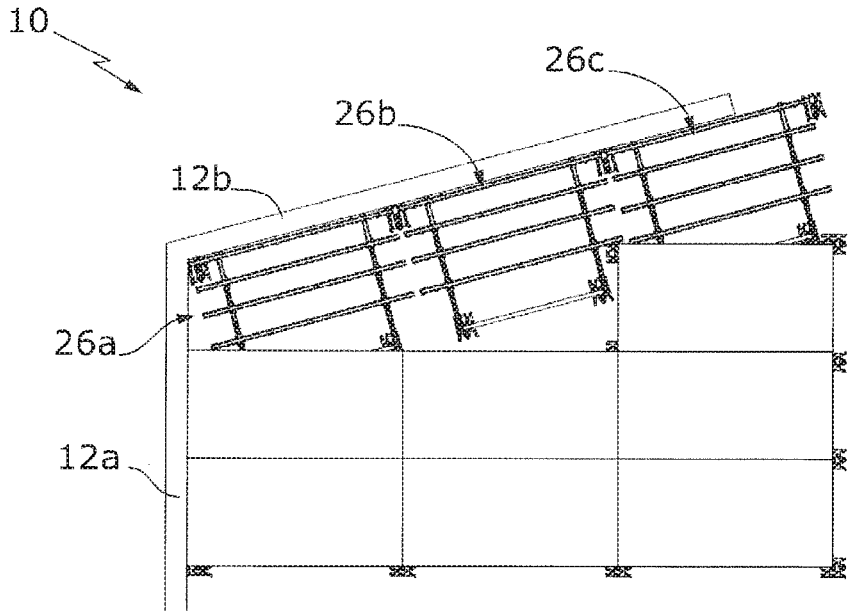
FIG. 8 shows a top view of a further ceiling formwork.

FIG. 8 shows a ceiling formwork 10 in which the formwork parts 26*a-c* are used in the case of a wall 12*b* that runs at an angle with respect to the wall 12*a*.

Figure 9:
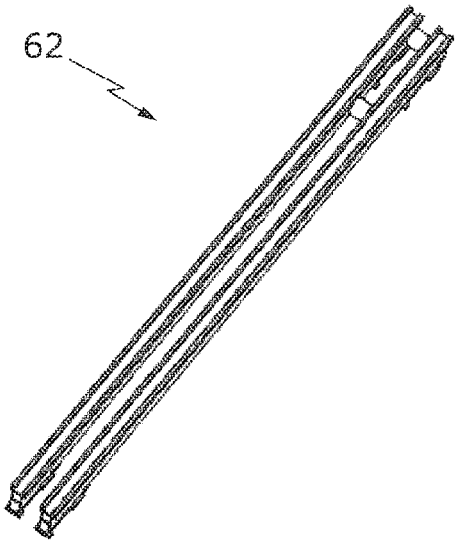
FIG. 9 shows a perspective view of a dual support.

FIG. 9 shows a dual support 62. The dual support 62, the same as the center support 50*a* (see FIG. 5), may be individually inserted between formwork elements 14 to allow narrow distances between formwork elements 14 to be provided with a compensation element formwork shell (not shown).

Figure 10:
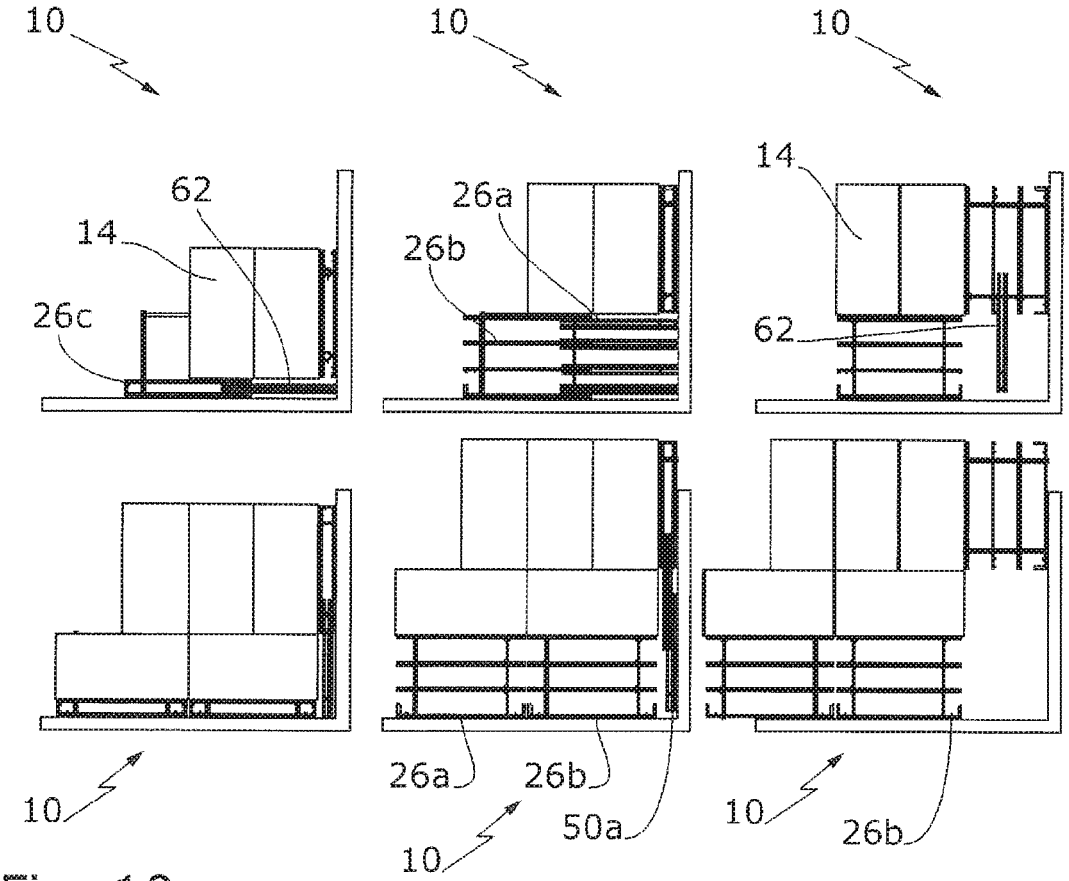
FIG. 10 shows top views of various possible applications of the formwork parts according to the invention.

FIG. 10 shows multiple ceiling formworks 10, which indicate by way of example various possible applications of formwork elements 14, formwork parts 26*a-c*, dual supports 62, and center supports 50*a*. Only some of these elements are provided with a reference numeral for reasons of clarity. It is apparent that dual supports 62 may also be supported on transverse supports 30*a*, 30*b*.

Considered in an overview of all figures of the drawing, the invention in summary relates to a formwork part 26*a-c* having a compensation element. The compensation element has a longitudinal support 32, and two transverse supports 30*a*, 30*b* that are connected to the longitudinal support 32. An outer support 36 is displaceably situated on the transverse supports 30*a*, 30*b*. In addition, at least one center support 50*a*, 50*b* may be fastened to the transverse supports 30*a*, 30*b* so as to be detachably removable from the transverse supports 30*a*, 30*b*. The longitudinal support 32, the outer support 36, and/or at least one center support 50*a*, 50*b* preferably have/has at least one support head receptacle at both ends, in particular in the form of a connecting protrusion 60*a-k*, in particular at least two support head receptacles, preferably in the form of connecting protrusions 60*a-k*. The connecting protrusions 60*a-k* may be hooked into ceiling supports 16 of the ceiling formwork 10. The invention further relates to a ceiling formwork 10 comprising such a formwork part 26*a-c* and a formwork element 14. The formwork element 14 preferably has at least one support head receptacle, in particular in the form of a connecting protrusion 60*a-k*, that may be hooked into the ceiling support 16 of the ceiling formwork 10. The ceiling formwork 10 may include the ceiling support 16. The ceiling formwork 10 may have a dual support 62.

The invention claimed is:

1. A ceiling formwork, comprising:

a formwork part for a ceiling formwork, the formwork part comprising a compensation element, wherein the compensation element comprises:

a base frame having a longitudinal support and two transverse supports that are fixedly connected to the longitudinal support, transversely with respect to the longitudinal support, the longitudinal support having a nail strip for fastening a compensation element formwork shell; and an outer support that is situated parallel to the longitudinal support and displaceably guided on the transverse supports, the outer support having a nail strip for fastening the compensation element formwork shell; and a framework element, wherein the framework element has a frame with a formwork shell parallel to a main plane of the frame, the frame in the main plane of the frame having a length and a width, wherein a difference between a) a maximum span width between the longitudinal support and the outer support, and b) a minimum span width between the longitudinal support and the outer support corresponds at least the width of the frame.

2. The ceiling formwork according to claim 1, further comprising a first center support situated parallel to the longitudinal support and reversibly detachably connected to the transverse supports, the first center support having a nail strip for fastening the compensation element formwork shell.

3. The ceiling formwork according to claim 2, wherein the first center support has a center support guide strip, the outer support has an outer support guide strip, and at least one of the transverse supports has a transverse support guide strip which i) is engaged from behind by the center support guide strip of the first center support, so that the first center support is displaceably guidable on the transverse supports and/or ii) is engaged from behind by the outer support guide strip of the outer support, so that the outer support is displaceably guidable on the transverse supports.

4. The ceiling formwork according to claim 2, wherein at least one of the transverse supports has a locking device by which a position of the center support is fixable relative to the transverse supports.

5. The ceiling formwork according to claim 2, wherein the first center support has support head receptacles, which for installation of the first center support on a support head of the ceiling formwork are arranged or provided on lengthwise ends of the first center support, the first center support without the compensation element being arrangeable on the ceiling formwork, between two support heads.

6. The ceiling formwork according to claim 1, wherein the longitudinal support has support head receptacles, which for installation of the longitudinal support on a support head of the ceiling formwork are arranged or provided on lengthwise ends of the longitudinal support.

7. The ceiling formwork according to claim 6, wherein the support head receptacles are formed as connecting protrusions.

8. The ceiling formwork according to claim 1, wherein the outer support has support head receptacles, which for installation of the outer support on a support head of the ceiling formwork are arranged or provided on lengthwise ends of the outer support.

9. The ceiling formwork according to claim 8, wherein the support head receptacles are formed as connecting protrusions.

10. The ceiling formwork according to claim 2, wherein the compensation element has multiple center supports that are identical to the first center support, the center supports being situated on the transverse supports.

11. The ceiling formwork according to claim 1, wherein the base frame has a longitudinal connector that is parallel to the longitudinal support and connects the transverse supports to one another.

12. The ceiling formwork according to claim 5, further comprising a support head arranged on one of the support head receptacles.

13. The ceiling formwork according to claim 1, further comprising a compensation element formwork shell connected to the compensation element.

14. The ceiling formwork according to claim 1, further comprising: support heads; a dual support with support head receptacles on lengthwise ends of the dual support for installing the dual support on the support heads of the ceiling formwork; and at least one nail strip, wherein the dual support without the compensation element is arrangeable between two support heads.

15. The ceiling formwork according to claim 1, wherein the outer support is displaceably arranged on the transverse supports so as to be detachably removable, but not in a reversible manner, from the transverse supports.

* * * * *